US007594978B2

(12) United States Patent
Brecher et al.

(10) Patent No.: US 7,594,978 B2
(45) Date of Patent: Sep. 29, 2009

(54) APPARATUS FOR CONTINUOUS COKING REFINING

(75) Inventors: Lee E. Brecher, Laramie, WY (US); Lyle A. Johnson, Jr., Casper, WY (US); Vijay K. Sethi, Laramie, WY (US)

(73) Assignee: The University of Wyoming Research Corporation, Laramie, WY (US)

( * ) Notice: Subject to any disclaimer, the term of this patent is extended or adjusted under 35 U.S.C. 154(b) by 531 days.

(21) Appl. No.: 11/264,712

(22) Filed: Nov. 1, 2005

(65) Prior Publication Data

US 2006/0049032 A1 Mar. 9, 2006

Related U.S. Application Data

(63) Continuation of application No. 10/130,921, filed as application No. PCT/US00/32029 on Nov. 21, 2000, now Pat. No. 6,972,085.

(60) Provisional application No. 60/167,337, filed on Nov. 24, 1999, provisional application No. 60/167,335, filed on Nov. 24, 1999.

(51) Int. Cl.
*C10B 1/08* (2006.01)

(52) U.S. Cl. ..... 202/128; 202/103; 202/116; 202/118; 202/218

(58) Field of Classification Search ..... 202/96, 202/103, 116, 118, 128, 218; 208/131; 201/2.5, 201/10, 12, 23
See application file for complete search history.

(56) References Cited

U.S. PATENT DOCUMENTS

| | | | | |
|---|---|---|---|---|
| 1,817,926 | A | | 8/1931 | McIntire |
| 2,657,120 | A | | 10/1953 | Bigsby et al. |
| 4,125,437 | A | | 11/1978 | Bacon |
| 4,200,517 | A | | 4/1980 | Chalamers et al. |
| 4,219,405 | A | | 8/1980 | Pietzka |
| 4,822,479 | A | | 4/1989 | Fu et al. |
| 4,983,278 | A | * | 1/1991 | Cha et al. ..... 208/407 |
| 5,041,209 | A | * | 8/1991 | Cha et al. ..... 208/251 R |
| 5,259,945 | A | * | 11/1993 | Johnson et al. ..... 208/13 |
| 5,318,697 | A | | 6/1994 | Paspek et al. |
| 5,645,712 | A | | 7/1997 | Roth |

(Continued)

FOREIGN PATENT DOCUMENTS

CA 2153395 2/1999

(Continued)

OTHER PUBLICATIONS

U.S. Appl. No. 10/130,921, Entitled Continuous Coking Refinery Methods and Apparatus, now Patent No. 6,972,085, the entire wrapper available on line.

(Continued)

*Primary Examiner*—N. Bhat
(74) *Attorney, Agent, or Firm*—Santangelo Law Offices, P.C.

(57) ABSTRACT

A system for refining hydrocarbon containing materials in a continuous coking mode may provide a pyrolyzer (1) which may be inclined to effect a liquid seal between a liquid conduction environment (6) and a gaseous conduction environment (7). A heat source (9) may heat the material past the coking point and the system may include a screw or auger (10) which can continuously remove the coke while simultaneously outputting refined products.

64 Claims, 7 Drawing Sheets

U.S. PATENT DOCUMENTS

| | | | | | |
|---|---|---|---|---|---|
| 5,653,865 | A | | 8/1997 | Miyasaki | |
| 5,753,086 | A | | 5/1998 | Guffey et al. | |
| 5,755,389 | A | | 5/1998 | Miyasaki | |
| 5,836,524 | A | * | 11/1998 | Wang | 241/23 |
| 6,972,085 | B1 | | 12/2005 | Brecher et al. | |

FOREIGN PATENT DOCUMENTS

| | | | |
|---|---|---|---|
| WO | WO 95/13338 | | 5/1995 |
| WO | WO 95/133338 | * | 5/1995 |
| WO | WO 01/38458 | | 5/2001 |

OTHER PUBLICATIONS

European Regional Application No. 00 980 646.4-2104; Examination report dated Jun. 24, 2004.

U.S. Appl. No. 60/167,337, "Methods and Apparatus for Heavy Oil Upgrading", filed Nov. 24, 1999.

U.S. Appl. No. 60/167,335, Methods and Apparatus for Improved Pyrolysis of Hydrocarbon.

* cited by examiner

APPARATUS FOR CONTINUOUS COKING REFINING

This application is a continuation of U.S. patent application Ser. No. 10/130,921, filed May 24, 2002, now U.S. Pat. No. 6,972,085 which was the U.S. national stage of International Application No. PCT/US00/32029, filed Nov. 21, 2000, which claimed the benefit of U.S. Provisional Patent Application No. 60/167,337, filed Nov. 24, 1999, and U.S. Provisional Patent Application No. 60/167,335, filed Nov. 24, 1999, each hereby incorporated by reference.

I. TECHNICAL FIELD

The present invention relates to methods and apparatus for refining heavy oils such as in transforming heavy oils into lighter, or higher quality components which are more commercially useful.

II. BACKGROUND ART

Everyone is aware of the importance that oil and other such materials have on today's world. They represent an important topic from a wide range of perspectives ranging from environmental to economic to political. At a chemical level, these materials are significant because the substances of which they are composed have hydrogen and carbon containing molecules whose structure readily yields energy when burned. In some instances the naturally occurring raw materials are already in a desirable state. For example, $CH_4$, methane a "natural gas"—as its name implies—is often available in a preferred chemical composition in nature. Some hydrocarbons, however, do not significantly occur in a preferred state in nature.

Fortunately, most hydrocarbon molecules can be easily separated or transformed through thermal and chemical processes. The transformation and separation, usually done on a larger scale with creation and collection of the desired species is the process known popularly as a "refining" the material. To the populace, this is what a refinery does; it continuously takes raw, naturally occurring material and refines it into one or more forms that are more commercially desirable. As but one example, the heavier molecules found in bitumen can be split into lighter components through refining processes. From a simplified perspective, the process of refining material involves heating and altering the composition of the fuel materials by distillation, breaking or cracking the longer molecules into shorter ones, driving the various species off as volatile components, and then collecting substances in the desired form.

Many refining processes produce coke. When hydrocarbons are heated above certain temperatures, they can reach a point at which the carbon atoms bind together and form a substance known as coke. Coke can be problematic because it is a very hard and relatively untransformable substance which usually binds to its container when formed. Great pains are often taken in processing relative to coke. For example, there is a newly invented technique to identify the point at which coke may precipitously form. This technique, described in PCT Application No. PCT/US00/15950, hereby incorporated by reference, shows great promise.

Coking processes require careful handling. Here, processes are often accomplished in a batch or semi-batch modality. After coke has formed, the container is set apart to jackhammer or otherwise remove the coke from it. By its very nature, a true continuous process is difficult to achieve. In addition, because of the larger capital expense of such handling, at present only large refineries currently utilize coking as the principal method of upgrading heavy crude oils. Thus, while desirable for efficiency, smaller refineries have not been able to practically utilize coking processes on a commercially viable basis. Since the crude oil supplied to refineries is becoming heavier, this need is becoming more acute.

In spite of this need, however, a solution to the precipitous formation of coke and availability of coking processes has not been available to the degree commercially desired. Certainly the importance of the refining process is well known. There has been a long felt but unsatisfied need for more efficiency, for more availability, and for better handling of such processes. In spite of this long felt need, the appropriate process as not been available, however. As the present invention shows, through a different approach to the problems, a solution now can exist. Perhaps surprisingly, the present invention shows not only that a solution is available, it also shows that the solution is one that from some perspectives can be considered to use existing implementing arts and elements. By adapting some features from other fields of endeavor (such as the remediation or toxic waste recovery fields as mentioned in U.S. Pat. No. 5,259,945), the present invention can solve many of the problems long experienced by the refinery field.

To an extent, the present invention can be consider as showing that in the refining field those skilled in the art may have simply had too limited a perspective and while there were substantial attempts to achieve the desired goals, those involved failed perhaps because of a failure to appropriately understand the problem of coke formation in the appropriate context. In fact, the efforts may even have taught away from the technical direction in which the present inventors went and so the results might even be considered as unexpected. Thus the present invention may represent not merely an incremental advance over the prior art, it may provide a critically different approach which afford the ability to utilize coking process while also providing a continuous process operation. As will be seen, the physical features which permit this critical difference in performance are not merely subtleties in batch-type processing (such as might exist in a semi-batch modality), they are an entirely different way of dealing with the coke and the processes. Thus, until present invention no processes provided the ability to permit truly continuous, coking processing in the commercially practical manner now possible.

III. DISCLOSURE OF INVENTION

The present invention provides a continuous refining process which permits the intentional formation of coke from the material to be processed while acting to separate and perhaps create a greater quantity of refined products. In one embodiment, the invention utilizes an inclined auger with a medium such as sand in which the raw material is heated past the coking point. The auger then continuously moves the coke out of the bed so that constant and continuous refinement can occur.

Accordingly, it is one of the many goals of the present invention to provide a system through which continuous refining can occur even while permitting coke to form. In achieving such a goal the invention provides refinement in one system but with multiple zones so that the continuous process can be efficiently conducted.

Naturally, further objects of the invention are disclosed throughout other areas of the specification and claims.

IV. BRIEF DESCRIPTION OF DRAWINGS

V. BEST MODE(S) FOR CARRYING OUT THE INVENTION

Figure 1:
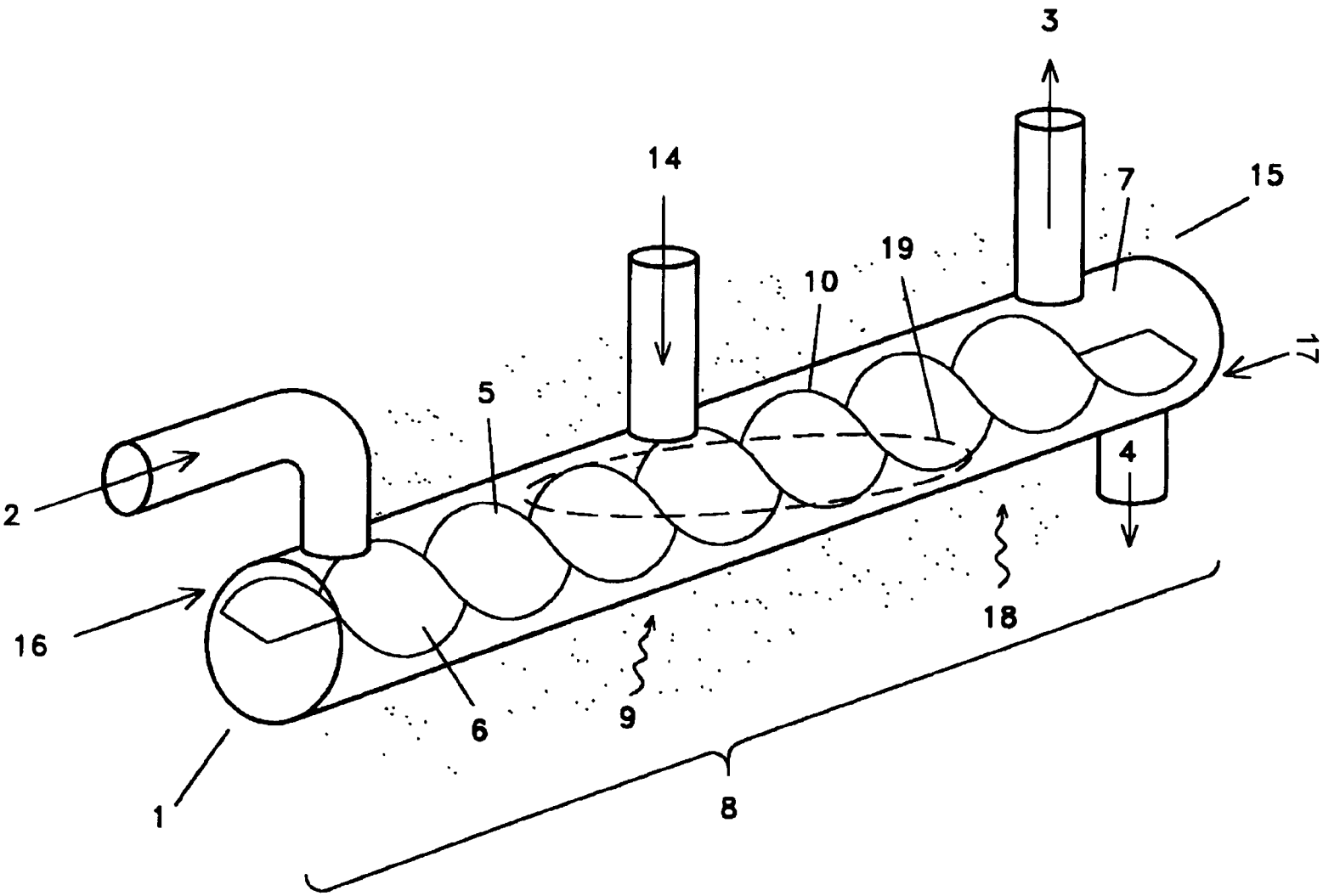
FIG. 1 is a schematic of an inclined auger-type of refining apparatus.

As can be seen from the drawings, the basic concepts of the present invention may be embodied in many different ways. FIG. 1 shows a schematic of an inclined auger-type of refining apparatus according to the present invention. This can be considered one of the many key components to an improved refining system. As an important feature of one embodiment, the system is designed not only to be able to accept heavy hydrocarbon containing material, it can do it on a continuous basis. As shown in FIG. 1, the refining apparatus may include a pyrolyzer (1) having a process container (5) within which refining can occur. The pyrolyzer (1) may have some type of input (2) through which material to be processed may travel. In keeping with one of the goals of the invention, the input (1) may be a continuous input such that material is provided into the pyrolyzer (1) at the same rate at which it is processed. The processing of the material may, of course, result in refined products which may flow out of an output such as volatiles output (3). It may also result in residuum or unrefined or even perhaps unrefinable material. These may flow out through some type of output such as residuum output (4).

As mentioned earlier, an desired aspect of at least one embodiment is the ability to process heavy hydrocarbon material. By this not only is the traditional definition of "heavy" intended, but also specific goals such as the ability to continuously input a material having an API gravity of at most about 11° API, heavy oils, asphalts, pitches, bitumens, material having an API gravity of less than about 11° API, material having an API gravity of less than about 10° API, material having an API gravity of less than about 7° API, and even material having an API gravity of less than about 3° API. Further, in one embodiment, there is also a desire to be able to handle and process materials which have significant amounts of residuum, including but not limited to material having at least 5% by weight residuum, material having at least 7% by weight residuum, material having at least 10% by weight residuum, and even material having at least 15% by weight residuum or higher.

The pyrolyzer (1) may alter the chemical composition of the material to be processed. Such may, of course include a variety of crudes, but also such materials as stripper bottoms and the like. For more effective processing, this may be accomplished through coking and cracking reactions which rearrange the hydrocarbons and redistribute the hydrogen. For example, through an embodiment of the present invention applied to the processing of Cold Lake crude, approximately 55% of the flash bottoms fed the stripper were recovered as distillate while 45% flowed as underflow to the pyrolyzer (1). The product off the pyrolyzer (1) can even be a light, residuum-free distillate with an API gravity in the 25 to 60 degree range. Importantly, the pyrolyzer (1) can produce a light hydrocarbon oil which, once stabilized, can contribute significantly to overall product value.

Figure 2:
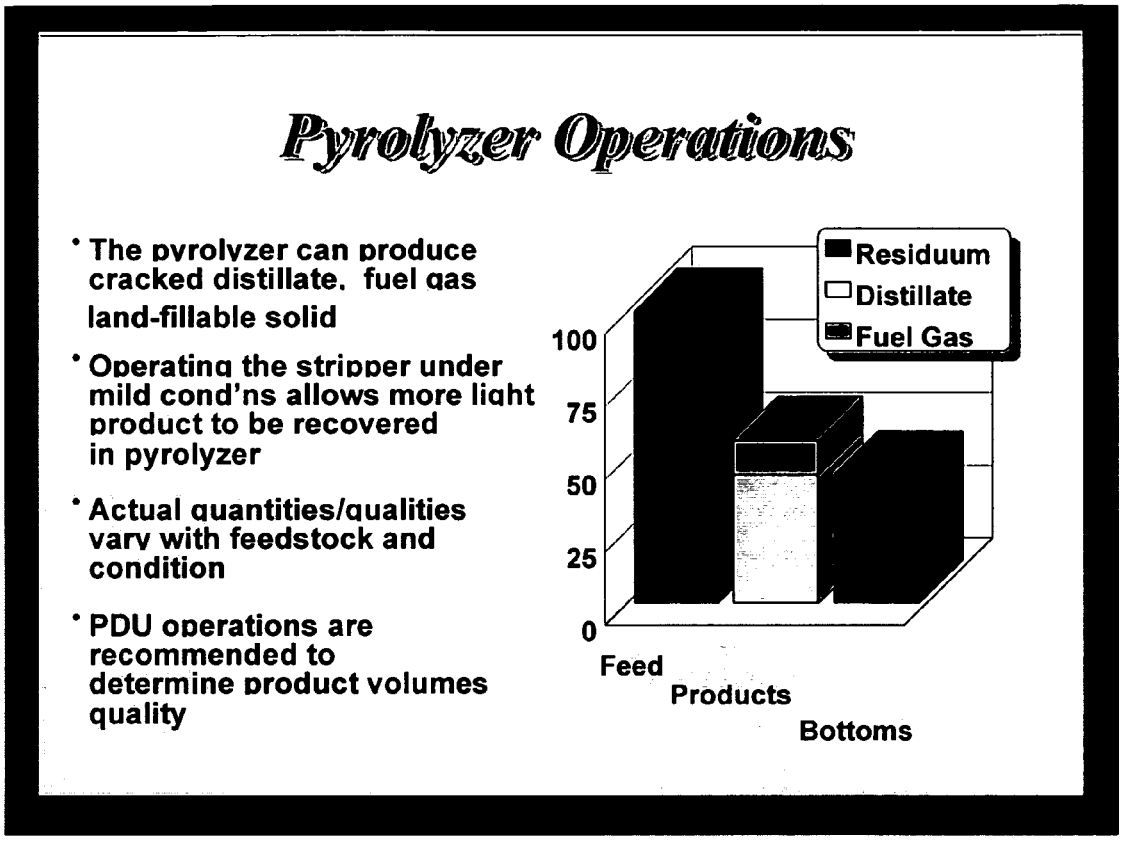
FIG. 2 is a diagram of an output of an embodiment of the present invention in one application.

Pyrolyzing can include coking and cracking of the heavy oil or material to produce additional light, residuum-free oil, fuel gas to power the process, and a solid similar to petroleum-coke for land-filling. Referring to FIG. 2, in this example, it can be understood that by weight it is estimated approximately 44% of the feed to the pyrolyzer (1) can emerge as liquid, about 12% can emerge as fuel gas and about 44% can emerge as coke. The pyrolyzer (1) can also be used to process solids, particularly hydrocarbon-laden solids, of course.

In one design, the pyrolyzer (1) can coke approximately 75 bpd of heavy oils or even stripper bottoms at temperatures about 1000° F. The pyrolyzer (1) can also be combined with other process elements such as strippers and flashers or the like. Whereas the pyrolyzer alters the chemical composition, the flash and stripping operations may be thermal separations with a variety of options.

As may be easily understood, the pyrolyzer (1) may achieve the refining of the hydrocarbon material by utilizing a refining environment and even continuously volatilizing substances. The system can then use those substances as or to form refined products. For example, desired non-condensible gases can be recovered and reused as process fuel or can be flared. As material progresses further into a hot zone, cracking and coking of the remaining heavier hydrocarbon may occur. In one embodiment, this can occur to or even past the coking point, thus a greater amount of recovery and refining can be achieved. Significantly, one system combines a coking type of processing with a continuous input and continuously inputting the material to be processed, to permit enhanced outputs. Thus, the input (2) to a process container (5) may be adapted to continuously accept material.

It may be important to understand that the system can provide differential processing. This may occur through use of more than one refining environment. By this, it should be understood that different conduction, temperature, locational, flow, or other types of zone can be encompassed. Referring to FIG. 1, it can be understood how a preferred embodiment can have multiple refining environments in yet one process container (5). In this embodiment, the multiple zones are achieved by inclining process container (5) and providing it in a less than full condition. As shown, there is a first refining environment such as the totally liquid conduction environment (6) and a second refining environment such as the totally gaseous conduction environment (7). These environments may establish different thermal environments between which the temperature, rate of conduction or other thermal differences may exist. This may occur over an effective processing length (8) in one container such as the one process container (5).

As shown, after introducing the material through input (2), the refining or material refinement may be initiated in a first refining environment, shown here as liquid conduction environment (6). It may then be pushed, be pulled, or otherwise travel to continue material refinement in a second refining environment, shown here as gaseous conduction environment (7). After the material is introduced through input (2), it may be heated by some type of heat source (9). [This may, of course, include a great variety of heat sources and so is shown only schematically.] This raises the temperature of the material, and as that temperature is raised, different volatile substances are driven off. These can be collected through volatiles output (3) as mentioned earlier. Since energy is used to drive off volatiles, as the material travels down length (8) of process container (5), it may continue its heating. This may drive off other volatiles and may cause cracking of the heavier hydrocarbons and may eventually reach the point at which coke forms for that material, that is, the coke formation temperature.

As shown by the dotted line in FIG. 1, liquid conduction environment (6) eventually terminates and next exists gaseous conduction environment (7). By inclining process container (5), this may exist over a distance. Thus a third refining environment can be considered to exist, here, an environment which transitions between purely liquid and gaseous states. Again, as the material travels across the pyrolyzer (1), it can be considered as being subjecting to a third refining environment, here, the region in which there is a combination of said first and said second refining environments, namely the partially liquid and partially gaseous environment. This can afford refining advantages. As can be understood, the third refining environment can considered be a third thermal environment or a transition refining environment. Through the inclined design shown, this transition environment can present a gradual transition environment, or even a linear transition environment whereby the amount of one environment (liquid) linearly decreases while the amount of another environment (gaseous) linearly increases. In this region, there is, of course, a combined liquid and gaseous conduction environment.

The allocation of the amount and changes in the various processing environments can be noteworthy as well. As can be understood from the drawing, at least about the lower one-third of the processing length (8) or about one-third of the process container (1) may contain the or some of the first refining environment or liquid conduction environment (6). This may also be increased or decreased to other lengths. Particularly, even at least about one-half of the processing length (8) or about one-half of the process container (5) may be used for the liquid conduction environment (6). Thus, in an inclined pyrolyzer (1) embodiment, the lower one-third or even lower one-half may be the liquid or un-volatilized material area.

As mentioned earlier, the material being processed may be pushed, be pulled, or otherwise travel in the pyrolyzer (1). It may affirmatively be accomplished. This moving of the material may be from a first refining environment to a second refining environment. As shown a screw or auger (10) may be but one way to accomplish this movement, among other purposes. The screw or auger (10) may thus serve as a movement element which operates through the liquid conduction environment (6) and into the gaseous conduction environment (7). In the arrangement shown, the lower one-third to one-half of the inclined screw can be filled with hot liquid which subsequently cokes and is augered up and out of the system.

Figure 4:
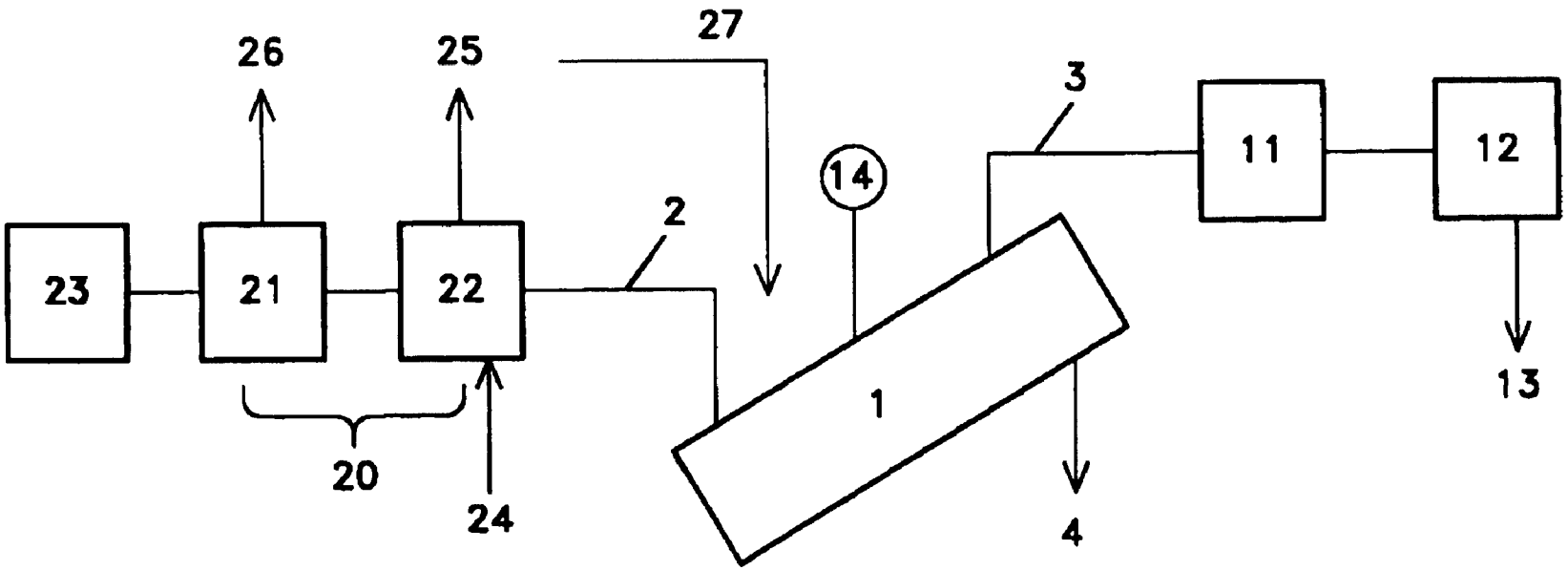
FIG. 4 is a schematic of one type of overall system.

FIG. 4 is a schematic of an overall system according to one embodiment of the invention. As can be understood, volatiles output (3) may feed [with or without a post-refinement treater (11)] into some type of collector, such as a condenser (12). Regardless as to how designed, the collector usually would act to output the desired refined products. Often, of course this may be done separately, however, for simplicity it is shown conceptually only as a single refined product output (13). These various items would accomplish collecting the refined products or perhaps condensing at least some of the results of the refining process. As envisioned in one preferred embodiment, they would be configured and operated for collecting refined products having an API gravity of at least about 25° API, of up to at least about 60° API, or perhaps so that the refined products would have an API gravity of at least about 26° API, of no more than about 3.7% sulfur content, of no more than about 3.1% sulfur content, or even having the characteristics of a fuel gas. Thus the elements may be adapted to receive at least some of the volatilized substances created by the refining processes and for collecting at least some of the refined products.

In order to facilitate the refinement process, a sweep gas may be used. This is shown in FIGS. 1 and 4 where a sweep gas input (14) is depicted. As shown, it may be advantageous to establish the sweep gas input (14) as situated behind the point at which the liquid terminates, an area of a liquid seal as discussed later. Additionally, of course, the sweep gas output, shown as coincident with the volatiles output (3) may be established behind the liquid seal as well to facilitate the withdrawal of the refined volatiles.

In heating the material to be processed, it may be highly desirable to intentionally heat that material beyond the coking temperature. Thus, coke will likely be formed. Rather than merely having some incidental formation of coke, this type of an embodiment of the invention may intentionally and affirmatively substantially exceed the coke formation temperature within the material. This will, of course result in exactly the substance which had previously been considered undesirable in some systems and may cause the forming of a substantial amount of coke from at least some of said material (e.g. the material that has not been volatilized). High residuum material can thus be used efficiently, including but not limited to material which would result in at least about 1%, 2%, 5%, 10%, 20%, or even as mentioned 44% of input material by weight of coke material. A variety of temperatures may be used to result in the forming of a substantial amount of coke from at least some of such material. These can include temperatures in which the heat source (9) is operated as a coke formation heat source to cause the material to achieve at least about 650° F., 700° F., 750° F., 800° F., 900° F., 950° F., 1000° F., 1100° F., and even 1200° F. or more.

As mentioned earlier, at least some of the material to be processed may be moved from input to output. When coke is formed, this element can take on an additional role. The movement element, shown in FIG. 1 as the screw or auger (10), may thus operates at least between a continuous input and a continuous coke output element. Besides operating to auger the material up the incline of the process container (5), it may serve to force the coke out of the process container (5). As can be appreciated, the movement element may serve to grind, abrade, auger, shearing, break, or otherwise cause the coke formed to be forced out of the process container (5). Importantly for one embodiment, the removing of coke may occur while the coke is being formed by the heating of the material. It may present a continuous removal process as desired in some embodiments.

The coke, remaining material, or even residuum may then exit the pyrolyzer (1) at a remaining material output such as the residuum output (4). By being able to present a continuous process, the residuum or remaining material may be especially appropriate for disposal. Depending on the initial material processed and the configuration of the system, it may even present a residuum which cokes substantially (i.e. greater than 80%, 85%, 90%, 95%, or even 98%) all of the un-volatilized organic material or residuum. Thus, by the time the material leaves the pyrolyzer, nearly all volatile hydrocarbon may have been removed and only inorganic solids and petroleum coke may remain. Even the remaining coke may be more appropriate for disposal. A system according to one embodiment of the present invention may continuously remove or create coke having no more than about 6.7% sulfur content or even having no more than about 3.7% sulfur content. Thus the screw or auger (10) may serve as a continuous coke output element and the system may operate to form coke out of substantially all un-volatilized organic material. Obviously, when the system can be designed so that the coke formation heat source operates to form coke out of substantially all residuum, an optimal situation may exist.

In understanding how the screw or auger (10) may serve as a continuous coke output element, it should be appreciated that such an arrangement is but one way to configure the system. As one of ordinary skill in the art would readily appreciate, many other way are possible including but not limited utilizing a coke grinder, a coke abrader, a coke auger, a coke shear element, a coke break element, or many other types of elements. Importantly from the perspective of efficiency, the output element may be operated while the coke formation heat source acts to form coke and may serve as a continuous coke output element to which the remaining material is responsive. Again, the inclined screw arrangement is merely one representative design.

To promote the desired heat transfer, the pyrolyzer (1) can include a fluidized bed of hot sand such as sand bed (15) as a high conduction energy transfer element. As is well known, the sand bed (15) may have a gas feed (18) to enhance conduction. Into the bed may be immersed the rotary screws. Incoming material to be processed may be fed into these screws and augered into the hot zone of the pyrolyzer. As the material is heated within the screw, it can evolve light hydrocarbon vapors which may be removed, condensed and recovered as liquid hydrocarbon product. The system may then accomplish outputting of the residuum of material or the coke through residuum output (4). The remaining coke may be disposed of. By using the sand bed (15) as a high conduction energy transfer element, proper processing can be facilitated. For example, the heat may be transferred at a rate to properly establish a first thermal environment within which material may be processed. By establishing a second thermal environment which differs from the first environment, heat may be transferred differentially. For example, by establishing a liquid conduction environment there may be a greater conduction of heat in that environment than in the gaseous conduction environment. The high conduction energy transfer element which may be effective over an effective process length (as one example, a length in which the refining occurs and is significantly influenced by the heat source) may thus be coordinated with the one or more refinery characteristics (e.g., heat of heat transfer, speed of the screw, amount of heat supplied, etc.) to present an optimal system. As mentioned, the pyrolyzer can use a fluidized bed of hot sand into which rotary screws are immersed, however, this should understood as only one type of highly conducting energy design.

In embodiments utilizing an incline, the material may be moved on an incline such as that shown to exist within process container (5) as it moves from input (2) to an output. Thus the system may present an inclined refinement process area. Correspondingly, there may be an inclined movement element to which the material is responsive, such as the inclined screw or auger (10) depicted within the inclined refinement process area. The incline may also serve to create a seal between the volatiles and the input (2). As shown, the pyrolyzer (1) may have an input end top (16) and an output end bottom (17) which differ in level height. This may serve to create a totally liquid area and a totally gaseous area to facilitate sealing.

The amount of the incline may vary with the amount and type of material being process, the geometry of the system, and other factors. As but one example, an angle of at least about: 15°, 22.5°, 30°, and 45° may serve to achieve the desired sealing and refining operations. Further, all that may be necessary is that the output end bottom (17) be substantially higher than said input end top (16) so that blow back of the volatiles does not occur. Additionally, the incline should not be so steep that the coke or other remaining material cannot pass up the incline through operation of the movement element such as screw or auger (10). Thus the movement element may serve as an incline overpower movement element so that the refining of the material occurs on the incline creating refined products perhaps throughout that element and moves in a manner which overcomes the effects of the incline. The output end bottom (17) may even be substantially above said liquid level so that once can be certain only coke, and not unprocessed material is removed.

In such a configuration, the unit's throughput can also be determined by either the reaction kinetics or the rate of heat transfer. Since the lower portion of the screw can be liquid-filled, heat transfer in this region can be rapid on the process side and can be controlled by the convective heat transfer on the gas side of the screw. The use of a fluidized bed on the gas side can also lead to very rapid heat transfer to the screw, thus, in service the pyrolyzer throughput can be controlled by the kinetics of the coking reactions. The length, speed, and other process parameters can thus be set based upon a variety of factors, including but not limited to the amount of thermal transfer in apparatus, the speed at which said apparatus is operated, the amount of heat supplied in the apparatus, the amount of thermal transfer in the gaseous conduction environment, the amount of thermal transfer in the high conduction energy transfer element, the kinetics of coking reactions occurring within the refinery apparatus, etc.

Through providing an inclined process area, an advantage in sealing the system can be achieved. As shown in FIG. 1, the input end top (16) of pyrolyzer (1) is higher than the output end bottom (17). This can be appreciated from the level line (19) which represents the level the liquid would tend to achieve under static conditions. Depending upon the speed at which screw or auger (10) operates, some liquid may, of course achieve a higher level toward the output end bottom (17). In a coking modality, one goal may be to avoid having any fluid reach the residuum output (4) so that only coke or other remainder is output from the system. This can be achieved by the incline creating a totally gaseous area on the output end. In addition, the incline can serve to create a totally liquid area on the input end to facilitate sealing the volatiles present at volatiles output (3) from pushing back and exiting out input (2). Much like a liquid trap, the incline is one way to establish a liquid seal between the input (2) and the output. Instead of providing a separate element to achieve the seal, the present invention utilizes at least some of the material to be processed as a more efficient system. A variety of levels of seal are possible, of course including but not limited to: at least about a 1 psi seal, at least about a 2 psi seal, a seal having at least 2 feet of liquid head or depth, a seal having at least 1 foot of liquid head, a seal located about mid way between the input and output, and a seal adequate to avoid blow back of the results from continuously volatilizing substances. As can be appreciated, the seal may be established at an interface between the material and the volatilized substances. In creating the seal, the incline serves to establish a seal-creation inclined refinement process area. It is also made up of and utilizes the input or hydrocarbon material.

As will be easily understood by those of ordinary skill in the art, the material being refined by pyrolyzer (1) may be treated before it goes into the pyrolyzer (1) and after it comes out from the pyrolyzer (1). Such steps and elements are shown schematically in FIG. 4. In a broader sense, the step of pretreating the material, of course occurs before accomplishing the continuous volatilization of substances and may be accomplished by one or more types of a pretreater (20).

Some of the types of functions which may be used include, but are not limited to: thermal treating, flashing, stripping, and the various permutations and combinations of these and other steps. Considering the pyrolyzer (1) as the focus refinery apparatus, this refinery apparatus is responsive to the various pretreatment elements whether they be a thermal treater, a flasher, a stripper, or the like. As shown in FIG. 4, both a flasher (21) and a stripper (22) are shown as utilized in this one embodiment.

As can be appreciated from FIG. 4, the flow of material is from unprocessed material source (23) to refined product output (13). As part of the particular pretreater (20) depicted, both a flasher (21) and a stripper (22) are utilized. The stripper (22) may be an atmospheric distillation unit with the solids agitated by a stripper sweep gas provided through a stripper sweep gas feed (24) to bubble through the still. In addition to providing agitation, this gas may also lower the partial pressures of the distilling hydrocarbons thus achieving some of the advantages of a vacuum still. The nature of the oil or other hydrocarbons fed to the stripper (22) (particularly its boiling point curve and specific gravity) can have a significant influence on the amount of product taken off the stripper (22) in stripper output (25) as well as the pyrolyzer (1) and the quality of that product. Varying the operating temperature of stripper (22) may produce greater or lesser amounts of distillate in the overhead with the balance reporting with the residuum to the stripper bottoms. These stripper bottoms may be fed to the pyrolyzer (1). Using the Cold Lake crude as an example, it is estimated that approximately 55% of the crude will be recovered as distillate from the stripper as a 20.2 deg API oil having a sulfur content of 2.9 weight percent. Then the refined product off the pyrolyzer (1) can be a light, residuum-free distillate with an API gravity in the 25 to 60 degree range. The entire stripper operation can of course be varied. This may include a variety of steps including but not limited to: atmospherically distilling, bubbling a sweep gas through material, both atmospherically distilling and bubbling a sweep gas through the material, creating at least about some 20° API material, creating at least about some 60° API material, and the permutations and combinations of each of these. Thus the stripper (22) may include an atmospheric distiller, a sweep gas feed (24), and both of these.

Figure 5:
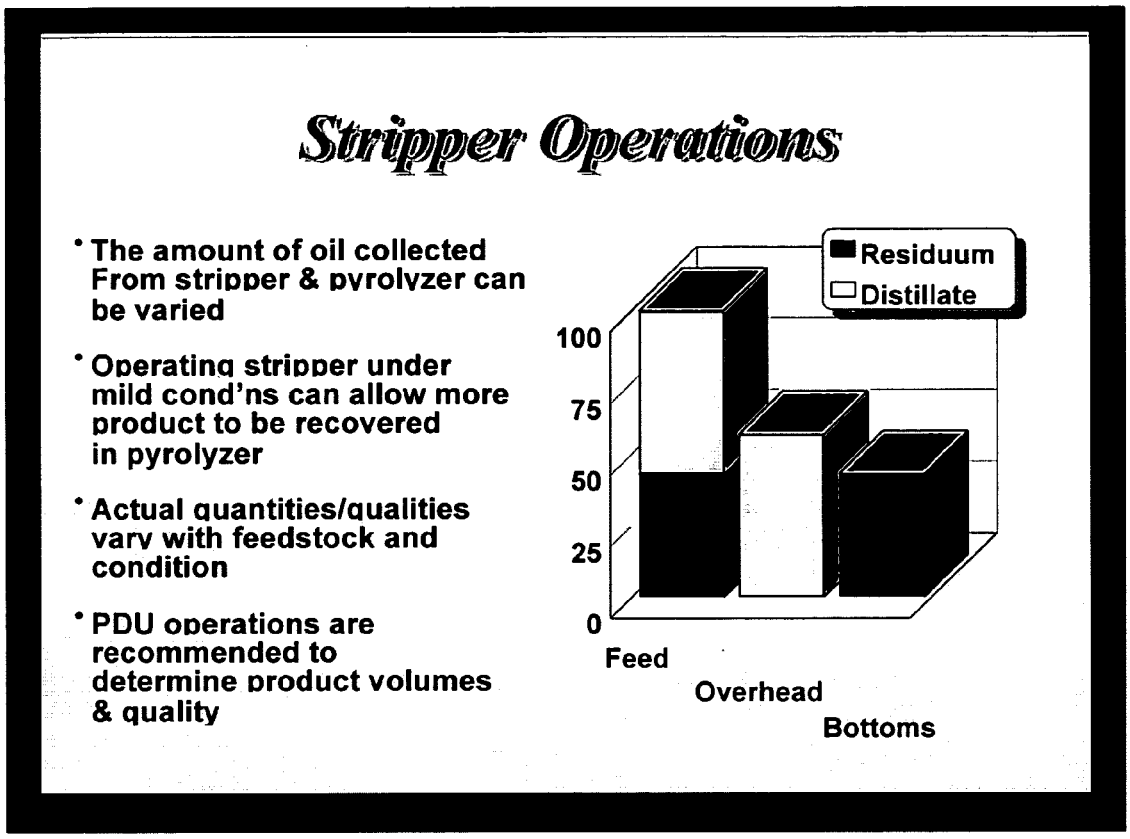
FIG. 5 is a diagram of one type of process material.
Figure 6:
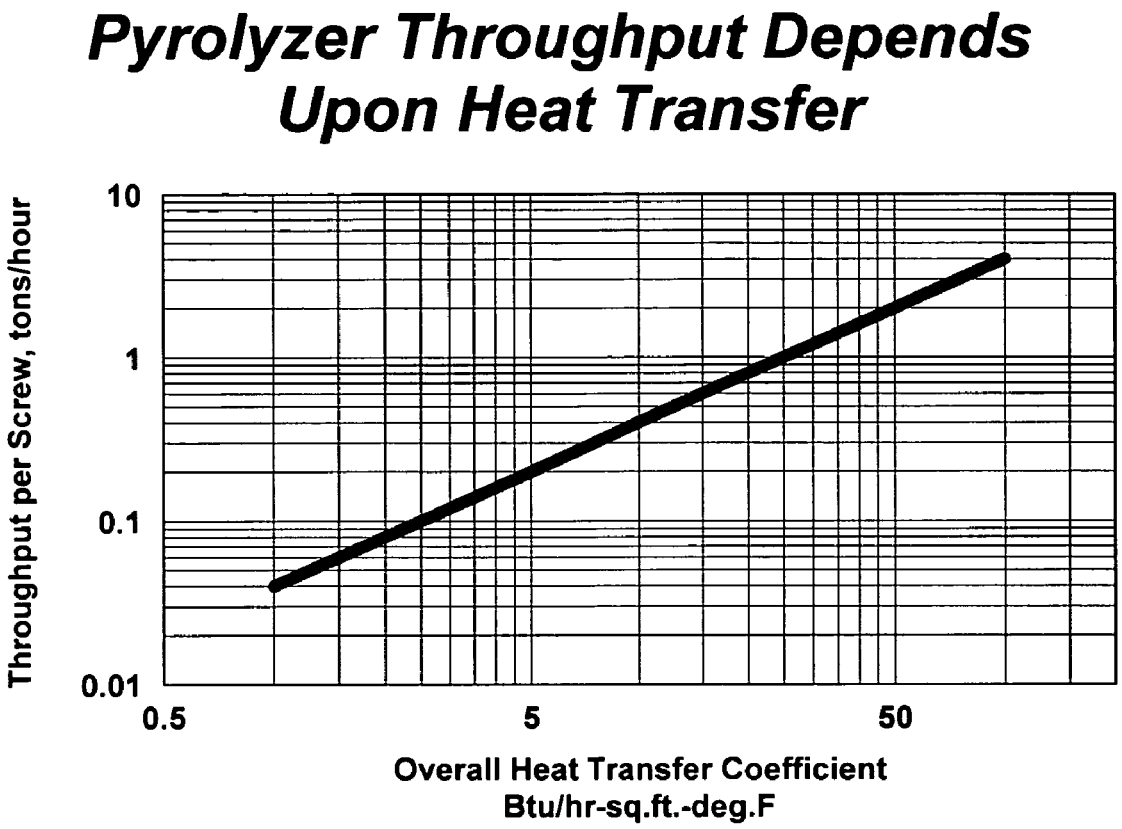
FIG. 6 is a chart of throughput for one embodiment of the present invention.
Figure 7:
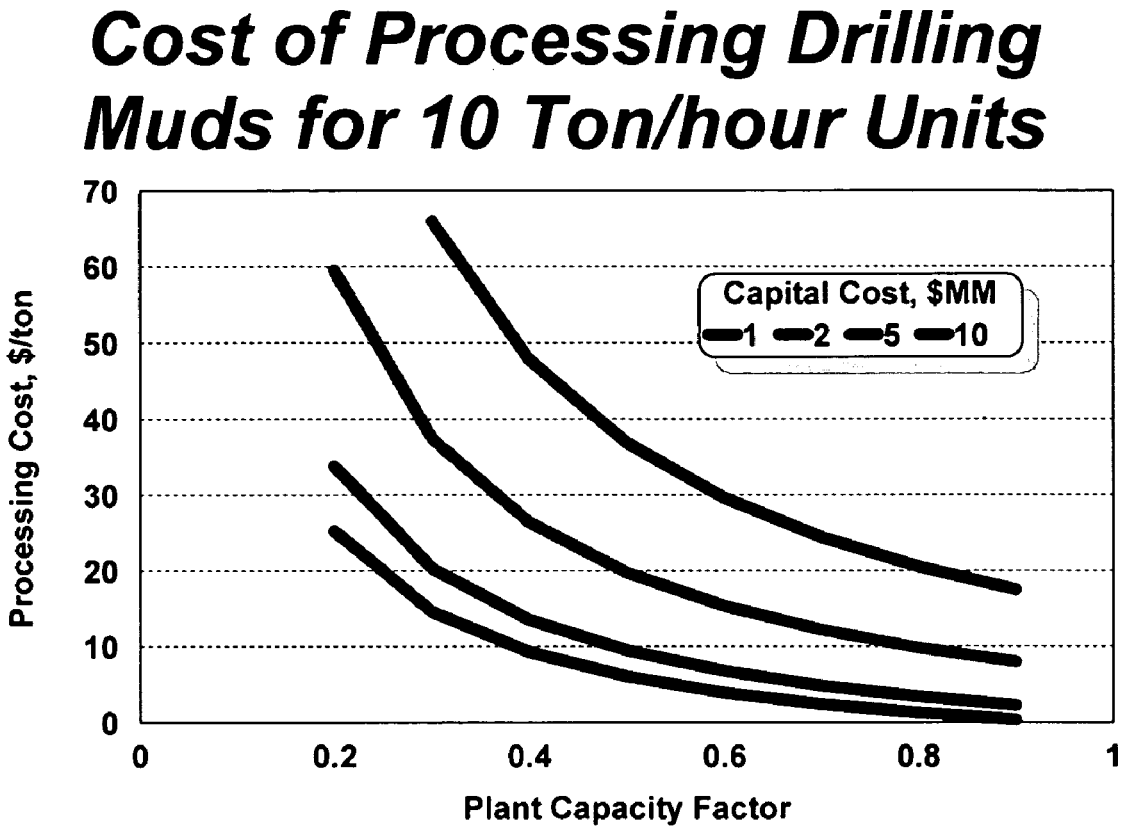
FIG. 7 is an estimate of the cost of processing drilling muds in one embodiment of the present invention.

As shown in FIG. 4, the pretreater (20) may also include elements to flash the material. This is shown generically as flasher (21). As summarized in FIG. 5, feed to one type of process material can consist of a mixture of oil, water and suspended solids. In processing such material, the mixture may be first heated under pressure to temperatures near 400° F., and then expanded through a flash valve to atmospheric pressure. This is a type of flashing with a sudden let-down in pressure to release the emulsified water as steam. This may be vented harmlessly to the stack (26). The warm flash bottoms can then be sent to the stripper (22) where the first product oil or other refined product can be recovered. The act of flashing the material can, of course be accomplished before accomplishing the step of continuously volatilizing substances. It may also be greatly varied and may include the steps of: heating the material to at least about 400° F., rapidly reducing the pressure of the heated material to about atmospheric pressure, and both of these. The unit, depicted generically as flasher (21) will then outputs at least some heavy hydrocarbon material for the refinery apparatus. Thus elements used may include a heat source which operates to achieve a material temperature of at least about 400° F., a pressure reducer, and generically an atmospheric flasher.

Figure 3:
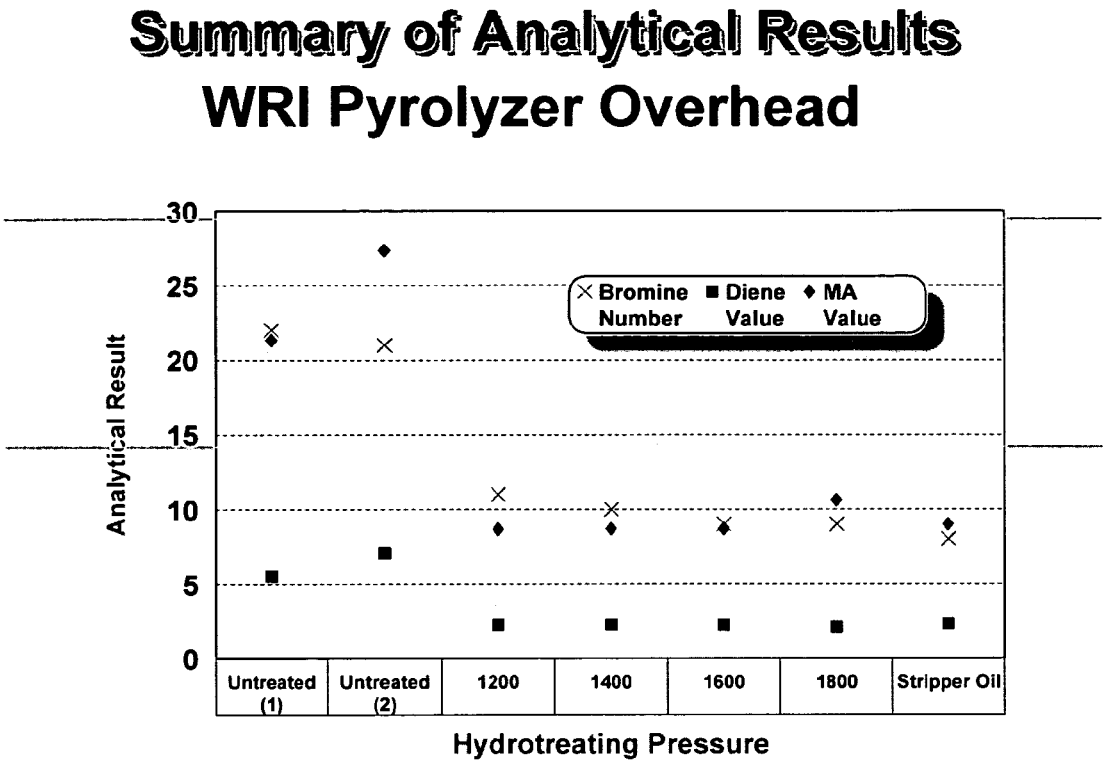
FIG. 3 is a diagram of a hydrotreating result on the pyrolyzer certain overheads.

Treating the refined products of pyrolyzer (1) may also be included. As shown this may be accomplished generically by a post-refinement treater (11). As its name implies, it may be configured to permit post-treating after the refined products of pyrolyzer (1) are created and may be located either before or after condenser (12). At least some of the volatilized substances may be fed into it and so the post-refinement treater (11) may be responsive to the refinery apparatus. One type of post-refinement treating may be hydrotreating such as where post-refinement treater (11) includes or serves as a hydrotreater. The chart in FIG. 3 is a summary of some hydrotreating results obtained on pyrolyzer overheads in the example. The sample labeled "Untreated 2" and the one labeled "Stripper Oil" were the samples discussed earlier. The remaining samples were generated during a test from an original material which is labeled "Untreated 1". The bromine number and diene value by maleic anhydride are empirical indications of the presence of olefins (bromine number) and conjugated dienes (dienes by maleic anhydride). The maleic anhydride value does not directly reflect the concentrations of dienes in the sample because the mass of each individual sample and the molality of the titrant is required for this calculation. Similarly, the diene value is an indication of conjugated double bonds and subject to interference from species such as anthracene and other polynuclear aromatic hydrocarbons which are abundant in these oils. As a result, the absolute significance of these values should be interpreted with caution.

The hydrotreating accomplished in this example is a hydrotreating of the refined products at least about 1800 psi through a pressure element (depicted as part of the pretreater) capable of achieving that pressure. From the result shown in FIG. 3, it is shown that hydrotreating at 1800 psi can lead to low hydrogen consumption, significantly reduced or eliminated olefin concentrations, an acceptable H/C ratio, and operating conditions conducive to maximum catalyst life. If some residual olefins do remain, these may not be highly reactive and it will likely not be necessary to saturate them in order to prevent gum formation. In addition, the extreme ease of cracking and subsequent resaturation suggests an alternate configuration where all material is first sent to the pyrolyzer and then hydrotreated so as to produce maximum quantities of light product oil for condensate replacement, blending and sale.

Efficient energy utilization and hydrogen management can be valuable to the self-sustaining design's thermal efficiency and low operating costs. The pyrolyzer can produce a light hydrocarbon oil which, once stabilized, can contribute significantly to overall product value. The hydrogen required to achieve this stabilization and to hydrotreat additional stripper overhead can also be derived from the coking of a portion of the stripper bottoms. In so doing, petroleum coke suitable for fueling the pyrolyzer may be produced. The remaining products, $C_1$ to $C_4$ hydrocarbons, may be sold as product. Overall, all of the incoming material can be converted to high value products or consumed as fuel.

On a BS&W-free basis, the process in the example can be configured to be capable of recovering approximately 80-85% of the original hydrocarbon as product oil with the remaining material split between process fuel gas and coke. On an overall process basis, and as but one example, processing the Cold Lake crude with the present invention process can produce 16,404 bpd of 26.5 deg API product oil containing 3.67% sulfur, 712 tons per day of coke containing 6.7% sulfur, and 6.18 MM scf/day of fuel gas with a HHV of 1328

Btu/scf. Of course, these processing steps have applications similar to those in a modern refinery. As a result, the technology, with appropriate variations and upgrades, is ideally suited for deployment in the oil fields as a mobile, modular, shop-fabricated refinement.

For further efficiency, the system may be designed to return some or even all the energy needed to run the process. It may be self sustaining by utilizing energy generated from the refined products in the method of refining. This may be accomplished by combusting non-condensible refined products generated in the method, among other returns. Thus the system may utilize substantially no input power to power the steps of the method of refining. In the schematic of FIG. 4, the energy reuse element (27) is conceptually shown as utilizing some output from stripper output (25) to return energy to the refinery apparatus (depicted as returning as heat input to pyrolyzer (1). It may also be wise to use some non-condensible refined products combustion element (depicted as part of the energy reuse element) to facilitate the energy return.

Plant Example

Cold Lake bitumen. An example of a 20,000 b/d plant processing the Cold Lake bitumen, an 11° API crude containing 4.6% sulfur is used to illustrate the principles involved in one approach. Upgrading this crude may produce 16,404 bpd of a 26.5° API product containing 3.1% sulfur by weight. The plant additionally may produce 712 tons/day of coke (6.74% S) and 6.2 MM scf/day of fuel gas having a HHV of 1328 Btu/scf. The facility may require no import power or fuel and would likely have an operating cost (exclusive of capital related charges) of less than Cdn $0.65/bbl. Capital costs for such a facility and others like it may be determined in partnership with heavy oil producers and the assignee of the present invention. However, based upon experience and estimates of the National Center for Upgrading Technology in Devon, Alberta, a total capital investment of Cdn $98.2 million for facilities and an operating cost, including capital costs, of Cdn $2.66 per barrel may be achieved. Of this, $2.02 are capital related charges and so a figure of this nature may be included as well. In this example, the process may also be configured to produce coke and fuel gas and may use no import power.

Although a different application, drilling muds and other challenging materials can be processed as well. In a powered system, gas and electric charges may be approximately $3.25/ton assuming power at 5 ¢/kWh and natural gas at $2.25/Mcf. As much as 30 gallons of diesel oil can be recovered per ton of material processed. This has been credited to the process at $10/ton after allowance for waste solid disposal by landfilling with operating labor, assumed to be $40/hour for two operators/shift around the clock. Capital charges can be estimated to be 15% of total capital investment. Although preliminary, these economics suggest that processing charges of $30/ton or less should be possible for reasonable ranges of specific capital investment and for reasonable plant operating factors.

In this different type of application, namely that not for a continuous refinement of supplied heavy oils but rather that of thermally removing hydrocarbon from drilling muds or other such waste products, heat transfer can be arranged to be rapid from the fluidized bed to the shell of the screw and vaporization can be nearly instantaneous once evaporation temperatures are reached. In this instance, the material in the screw can be either a mud or a damp solid with a resultant process side heat transfer coefficient which might be considerably lower than that of the earlier case. Here the overall throughput may be controlled by the rate of heat transfer from the shell of the inclined screw to the interior mass of damp solid on the process side. Such individual heat transfer coefficients and their effects on any such process or the overall heat transfer may need to be measured experimentally. Thus it can be seen that the present invention may apply to, but not be limited to, heavy oils from crude oil and any other mixtures of hydrocarbon products, water and sediments. Although perhaps of less commercial significance it may be used to transform waste materials such as tank bottom wastes and drilling muds. Such a use of some components of the present invention can be for waste material recovery as discussed in a U.S. Pat. No. 5,259,945, hereby incorporated by reference. This process, referred to as "TaBoRR" processing (a trademark of the assignee), is a process of recovering distilled and upgraded oil from mixtures of oil, water and sediments. The economics of processing such drilling muds or the like in a pyrolyzer of the present invention is preliminarily estimated in the chart in FIG. 3. Specific capital investment may depend upon the heat transfer coefficients determined during the experimental program, but are expected to vary between 0.1 to 1 $MM/ton/hour.

As may be easily understood from the foregoing, the basic concepts of the present invention may be embodied in a variety of ways. It involves both refining techniques as well as devices to accomplish the appropriate refining. In this application, the refining techniques are disclosed as part of the results shown to be achieved by the various devices described and as steps that are inherent to utilization. As but a few examples, the refining techniques may be used in, but not limited to, heavy oil upgrading, tar sand processing, production pits, crude oil refining, and other small or large refineries. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element that causes that action. Similarly, each physical element disclosed should be understood to encompass a disclosure of the action that that physical element facilitates. Regarding this last aspect, as but one example, the disclosure of a "stripper" should be understood to encompass disclosure of the act of "stripping"—whether explicitly discussed or not—and, conversely, were there effectively disclosure of the act of "stripping", such a disclosure should be understood to encompass disclosure of a "stripper" and even a "means for stripping" Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in any information disclosure statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant.

Thus, the applicant should be understood to have support to claim and make a statement of invention to at least: i) each of the refining devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and U.S. Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A continuous coking refinery apparatus comprising:

a. a continuous input adapted to continuously accept material which contains at least some heavy hydrocarbon material;

b. a coke formation heat source to which said material is responsive, which causes volatilized substances to be emitted from said material, and which causes the substantial formation of a desired form of coke from at least some of said material in a single process container;

c. a volatiles output which is adapted to receive at least some of said volatilized substances; and d. a continuous coke output element;

and further comprising a first refining environment within which material is processed and a second refining environment within which material is processed, wherein said first refining environment comprises a liquid conduction environment and wherein said second refining environment comprises a gaseous conduction environment.

2. A continuous coking refinery apparatus as described in claim 1 wherein said coke formation heat source to which said material is responsive comprises a coke formation heat source which substantially exceeds a coke formation temperature within said material selected from a group consisting of: 650° F., 700° F., 750° F., 800° F., 900° F., 950° F., 1000° F., 1100° F., and 1200° F.

3. A continuous coking refinery apparatus as described in claim 2 wherein said continuous input adapted to continuously accept material which contains at least some heavy hydrocarbon material acts upon at least some material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

4. A continuous coking refinery apparatus as described in claim 2 wherein said coke formation heat source to which said material is responsive comprises a coke formation heat source which operates to form a substantial amount of coke from said material.

5. A continuous coking refinery apparatus as described in claim 4 wherein said coke formation heat source which operates to form a substantial amount of coke from said material is configured to operate to form an amount of coke from said material selected from a group consisting of at least about: 1% of said input material by weight of coke material, 2% of said input material by weight of coke material, 5% of said input material by weight of coke material, 10% of said input material by weight of coke material, 20% of said input material by weight of coke material, and 44% of said input material by weight of coke material.

6. A continuous coking refinery apparatus as described in claim 4 wherein said coke formation heat source which operates to form a substantial amount of coke from said material comprises a coke formation heat source which operates to form coke out of substantially all un-volatilized organic material.

7. A continuous coking refinery apparatus as described in claim 4 wherein said coke formation heat source which operates to form a substantial amount of coke from said material comprises a coke formation heat source which operates to form coke out of substantially all residuum.

8. A continuous coking refinery apparatus as described in claim 2 and further comprising a movement element which operates at least between said continuous input and said continuous coke output element.

9. A continuous coking refinery apparatus as described in claim 8 wherein said movement element which operates at least between said continuous input and said continuous coke output element comprises a movement element selected from a group consisting of: a coke grinder, a coke abrader, a coke auger, a coke shear element, and a coke break element.

10. A continuous coking refinery apparatus as described in claim 2 wherein said continuous coke output element operates while said coke formation heat source acts to form coke.

11. A continuous coking refinery apparatus as described in claim 2 and further comprising:

a. an inclined refinement process area within which at least some of said material and at least some of said volatilized substances are contained; and b. an inclined movement element to which said material is responsive within said inclined refinement process area.

12. A continuous coking refinery apparatus as described in claim 2 and further comprising a liquid seal established at an interface between said material and said volatilized substances.

13. A continuous coking refinery apparatus as described in claim 12 wherein said liquid seal established at an interface between said material and said volatilized substances comprises heavy hydrocarbon material.

14. A continuous coking refinery apparatus as described in claim 13 wherein said liquid seal comprises a seal selected from a group consisting of: at least about a 1 psi seal, at least about a 2 psi seal, a seal having at least 2 feet of liquid head, a seal having at least 1 foot of liquid head, a seal located about mid way between an input and an output, a seal adequate to avoid blow back of refined material.

15. A continuous coking refinery apparatus as described in claim 2 and further comprising a condenser responsive to said refinery apparatus and to which at least some of said volatilized substances are fed.

16. A continuous coking refinery apparatus as described in claim 2 and further comprising a pretreater to which said refinery apparatus is responsive and which outputs at least some heavy hydrocarbon material for said refinery apparatus.

17. A continuous coking refinery apparatus as described in claim 2 and further comprising a flasher to which said refinery apparatus is responsive and which outputs at least some heavy hydrocarbon material for said refinery apparatus.

18. A continuous coking refinery apparatus as described claim 2 and further comprising a post-refinement treater responsive to said refinery apparatus and to which at least some of said volatilized substances are fed.

19. A continuous coking refinery apparatus as described in claim 2 and further comprising an energy reuse element which returns energy to said refinery apparatus.

20. A differential processing refinery apparatus comprising:

a. an input to a process container adapted to continuously accept material wherein said material contains at least some heavy hydrocarbon material;

b. a heat source to which said material is responsive, which causes volatilized substances to be emitted from said material;

c. a first refining environment within said process container and within which material is processed;

d. a second refining environment within said process container and within which material is processed;

e. a volatiles output which is adapted to receive at least some of said volatilized substances; and f. a remaining material output;

wherein said first refining environment comprises a liquid conduction environment and wherein said second refining environment comprises a gaseous conduction environment.

21. A differential processing refinery apparatus as described in claim 20 wherein said heat source to which said material is responsive comprises a heat source which achieves a material temperature of at least a temperature selected from a group consisting of: 650° F., 700° F., 750° F., 800° F., 900° F., 950° F., 1000° F., 1100° F., and 1200° F. and wherein said input continuously accepts at least some heavy hydrocarbon material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

22. A differential processing refinery apparatus as described in claim 20 and further comprising a third refining environment within which material is processed.

23. A differential processing refinery apparatus as described in claim 22 wherein said third refining environment within which material is processed comprises a combination of said first and said second refining environments.

24. A differential processing refinery apparatus as described in claim 22 wherein said third refining environment within which material is processed comprises a transition refining environment.

25. A differential processing refinery apparatus as described in claim 24 wherein said transition refining environment comprises a transition refining environment selected from a group consisting of: a gradual transition environment, and a linear transition environment.

26. A differential processing refinery apparatus as described in claim 20 wherein said first refining environment comprises a first thermal environment, and wherein said second refining environment comprises a second thermal environment.

27. A differential processing refinery apparatus as described in claim 22 wherein said first refining environment comprises a first thermal environment, wherein said second refining environment comprises a second thermal environment, and wherein said third refining environment comprises a third thermal environment.

28. A differential processing refinery apparatus as described in claim 20 wherein said first refining environment comprises a liquid conduction environment and wherein said second refining environment comprises a gaseous conduction environment.

29. A differential processing refinery apparatus as described in claim 22 wherein said first refining environment comprises a liquid conduction environment, wherein said second refining environment comprises a gaseous conduction environment, and wherein said third refining environment comprises a combined liquid and gaseous conduction environment.

30. A differential processing refinery apparatus as described in claim 29 wherein said heat source to which said material is responsive comprises a heat source which achieves a material temperature of at least about a temperature selected from a group consisting of: 650° F., 700° F., 750° F., 800° F., 900° F., 950° F., 1000° F., 1100° F., and 1200° F. and wherein said input continuously accepts at least some heavy hydrocarbon material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

31. A differential processing refinery apparatus as described in claim 28 wherein said refinery apparatus has an effective processing length and wherein said liquid conduction environment has a length selected from a group consisting of: at least about ⅓ of said processing length, and at least about ½ of said processing length.

32. A differential processing refinery apparatus as described in claim 26 and further comprising a high conduction energy transfer element which is effective over an effective process length and wherein said effective process length is coordinated with a refinery characteristic selected from a group consisting of: the amount of thermal transfer in said apparatus, the speed at which said apparatus is operated, the amount of heat supplied in said apparatus, the amount of thermal transfer in said gaseous conduction environment, the amount of thermal transfer in said high conduction energy transfer element, the kinetics of coking reactions occurring within said refinery apparatus, and the permutations and combinations of each.

33. A differential processing refinery apparatus as described in claim 32 wherein said effective process length comprises at least a coke formation length.

34. A differential processing refinery apparatus as described in claim 28 and further comprising a continuous coke output element to which said remaining material is responsive.

35. A differential processing refinery apparatus as described in claim 28 and further comprising a movement element to which said material which contains at least some heavy hydrocarbon material is responsive.

36. A differential processing refinery apparatus as described in claim 28 and further comprising a liquid seal within said refinery apparatus between said input and said output.

37. A differential processing refinery apparatus as described in claim 36 wherein said liquid seal within said process container between said input and said output comprises heavy hydrocarbon material.

38. A differential processing refinery apparatus as described in claim 37 wherein said liquid seal within said process container between said input and said output comprises a liquid seal selected from a group consisting of: at least about a 1 psi seal, at least about a 2 psi seal, a seal having at least 2 feet of liquid head, a seal having at least 1 foot of liquid head, a seal located about mid way between an input and an output, a seal adequate to avoid blow back of refined material.

39. A refinery apparatus comprising:

a. an input adapted to continuously accept material wherein said material contains at least some heavy hydrocarbon material;

b. a heat source to which said material is responsive and which causes volatilized substances to be emitted from said material;

c. an inclined refinement process area within which at least some of said material and at least some of said volatilized substances are contained;

d. an inclined movement element to which said material is responsive; and e. a volatiles output which is adapted to receive at least some of said volatilized substances;

and further comprising a first refining environment within which material is processed and a second refining environment within which material is processed, wherein said first refining environment comprises a liquid conduction environment and wherein said second refining environment comprises a gaseous conduction environment.

40. A refinery apparatus as described in claim 39 wherein said heat source to which said material is responsive comprises a heat source which achieves a material temperature of at least about a temperature selected from a group consisting of: 650° F., 700° F., 750° F., 800° F., 900° F., 950° F., 1000° F., 1100° F., and 1200° F. and wherein said input continuously accepts at least some heavy hydrocarbon material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

41. A refinery apparatus as described in claim 39 wherein said inclined refinement process area within which at least some of said material and at least some of said volatilized substances are contained has an input end top and an output end bottom and wherein said output end bottom is higher than said input end top.

42. A refinery apparatus as described in claim 39 wherein said inclined refinement process area within which at least some of said material and at least some of said volatilized substances are contained has an incline selected from a group consisting of at least about: 15°, 22.5°, 30°, and 45°.

43. A refinery apparatus as described in claim 41 wherein said output end bottom is substantially higher than said input end top.

44. A refinery apparatus as described in claim 39 wherein said inclined refinement process area comprises a seal-creation inclined refinement process area.

45. A refinery apparatus as described in claim 44 wherein said seal-creation inclined refinement process area comprises input material.

46. A refinery apparatus as described in claim 45 wherein said seal-creation inclined refinement process area comprises a seal selected from a group consisting of: at least about a 1 psi seal, at least about a 2 psi seal, a seal having at least 2 feet of liquid head, a seal having at least 1 foot of liquid head, a seal located about mid way between an input and an output, a seal adequate to avoid blow back of refined material.

47. A refinery apparatus as described in claim 39 wherein said inclined movement element to which said material is responsive comprises an incline overpower movement element.

48. A refinery apparatus as described in claim 39 and further comprising a continuous coke output element to which said remaining material is responsive.

49. A refinery apparatus as described in claim 39 and further comprising a liquid seal within said process container between said input and said output.

50. A refinery apparatus as described in claim 49 wherein said liquid seal within said process container between said input and said output comprises heavy hydrocarbon material.

51. A refinery apparatus as described in claim 39 and further comprising a high conduction energy transfer element.

52. A refinery apparatus as described In claim 51 wherein said high conduction energy transfer element comprises an energy transfer element selected from a group consisting of: a fluidized bed, an energy transfer element having a conduction value of at least about 5 btu/hr/ft$^2$/° F., an energy transfer element having a conduction value of at least about 20 btu/hr/ft$^2$/° F., an energy transfer element having a conduction value of at least about 50 btu/hr/ft$^2$/° F., and an energy transfer element having a conduction value of at least about 100 btu/hr/ft$^2$/° F.

53. A refinery apparatus as described in claim 51 wherein said high conduction energy transfer element comprises:

a. a sand bed; and b. a gas feed.

54. A refinery apparatus comprising:

a. an input adapted to continuously accept material wherein said material contains at least some heavy hydrocarbon material;

b. a heat source to which said material is responsive and which causes volatilized substances to be emitted from said material;

c. a refinement process area within which at least some of said material and at least some of said volatilized substances are contained;

d. a liquid seal established at an interface between said material and said volatilized substances; and e. a volatiles output which is adapted to receive at least some of said volatilized substances.

55. A refinery apparatus as described in claim 54 wherein said heat source to which said material is responsive comprises a heat source which achieves a material temperature of at least about a temperature selected from a group consisting of: 650° F., 700° F., 750° F., 800° F., 900° F., 950° F., 1000° F., 1100° F., and 1200° F. and wherein said input continuously accepts at least some heavy hydrocarbon material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

56. A refinery apparatus as described in claim 54 wherein said liquid seal established at an interface between said material and said volatilized substances comprises heavy hydrocarbon material.

57. A refinery apparatus as described in claim 56 and further comprising a residuum output which is adapted to receive at least some residuum from said refinement process area.

58. A refinery apparatus as described in claim 54 wherein said liquid seal comprises a seal selected from a group consisting of: at least about a 1 psi seal, at least about a 2 psi seal, a seal having at least 2 feet of liquid head, a seal having at least 1 foot of liquid head, a seal located about mid way between an input and an output, a seal adequate to avoid blow back of refined products.

59. A refinery apparatus as described in claim 58 wherein said heat source to which said material is responsive comprises a heat source which achieves a material temperature of at least about a temperature selected from a group consisting of: 650° F., 700° F., 750° F., 800° F., 900° F., 950° F., 1000° F., 1100° F., and 1200° F. and wherein said input continuously accepts at least some heavy hydrocarbon material selected from a group consisting of: heavy oil, asphalt, pitch, bitumen, material having an API gravity of less than about 11° API, material having an API gravity of less than about 10° API, material having an API gravity of less than about 7° API, material having an API gravity of less than about 3° API, material having significant amounts of residuum, material having at least 5% by weight residuum, material having at least 7% by weight residuum, material having at least 10% by weight residuum, and material having at least 15% by weight residuum.

60. A refinery apparatus as described in claim 54 and further comprising:

a. a sweep gas input established behind said liquid seal; and b. a sweep gas output established behind said liquid seal.

61. A refinery apparatus as described in claim 54 and further comprising a continuous coke output element.

62. A refinery apparatus as described in claim 56 and further comprising a. a first refining environment within which material is processed; and b. a second refining environment within which material is processed.

63. A refinery apparatus as described in claim 62 wherein said first refining environment comprises a liquid conduction environment and wherein said second refining environment comprises a gaseous conduction environment.

64. A refinery apparatus as described in claim 54 and further comprising a movement element within said refinement process area.

* * * * *

UNITED STATES PATENT AND TRADEMARK OFFICE

CERTIFICATE OF CORRECTION

PATENT NO. : 7,594,978 B2
APPLICATION NO. : 11/264712
DATED : September 29, 2009
INVENTOR(S) : Lee E. Brecher, Lyle A. Johnson and Vijay K. Sethi It is certified that error appears in the above-identified patent and that said Letters Patent is hereby corrected as shown below:

Col. 1, line 13 insert the following:

--ACKNOWLEDGMENT OF GOVERNMENT SUPPORT

This patent relates to work performed under U.S. Department of Energy Cooperative Agreement Number DE-FC26-98FT40322. The U.S. government may have certain rights in this inventive technology, including "march-in" rights, as provided for by the terms of U.S. Department of Energy Cooperative Agreement Number DE-FC26-98FT40322.--

Signed and Sealed this

Thirteenth Day of July, 2010

David J. Kappos

David J. Kappos
*Director of the United States Patent and Trademark Office*